US005950508A

United States Patent [19]

Rossi

[11] Patent Number: 5,950,508

[45] Date of Patent: Sep. 14, 1999

[54] SINK CLIP TOOL

[76] Inventor: Joseph T. Rossi, 121 Deer Run Rd., Plantsville, Conn. 06479

[21] Appl. No.: 09/063,885

[22] Filed: Apr. 22, 1998

[51] Int. Cl.[6] ..... B25B 23/08

[52] U.S. Cl. ..... 81/451; 81/456; 81/180.1

[58] Field of Search ..... 81/451, 456, 180.1

[56] References Cited

U.S. PATENT DOCUMENTS

| | | | |
|---|---|---|---|
| 887,644 | 5/1908 | Jacobs . | |
| 1,318,088 | 10/1919 | Klein | 81/451 |
| 1,323,056 | 11/1919 | Hofmann . | |
| 1,677,473 | 7/1928 | Gast . | |
| 2,453,901 | 11/1948 | Gonsett et al. . | |
| 2,464,058 | 3/1949 | Rogers . | |
| 2,566,541 | 9/1951 | Weglarz . | |
| 3,177,910 | 4/1965 | Da Silva . | |
| 3,452,373 | 7/1969 | Vosbikian et al. . | |

FOREIGN PATENT DOCUMENTS

| | | |
|---|---|---|
| 3016932 | 11/1981 | Germany . |
| 3622199 | 1/1988 | Germany . |
| 602301 | 5/1948 | United Kingdom . |

*Primary Examiner*—David A. Scherbel
*Assistant Examiner*—Sinclair Skinner
*Attorney, Agent, or Firm*—Richard C. Litman

[57] ABSTRACT

A sink clip tool includes a working end for manipulating threaded fasteners having either slotted or hexagonal ends, as conventionally used in the installation of sinks and basins in countertops. The tool comprises a solid, elongate shank with a handle end and an opposite working end. The working end includes a screwdriver blade or bit which is recessed within or surrounded by a lateral guard or guards, to prevent the blade from slipping laterally from the slot of a slotted fastener. A hexagonal socket extends beyond the blade and blade guard, for manipulating fasteners having hexagonal heads. The blade guard(s) fit closely to each side or end of the blade, in order to fit closely about the relatively narrow end of the slotted studs used with sink clips. The diameter of the hexagonal socket is somewhat larger than the width of the screwdriver blade and space across the guard(s). One embodiment of the tool is formed with the tool shank, screwdriver blade, and hexagonal socket as a single, unitary component, while other embodiments provide for a selectively retractable and extendible hexagonal socket. The socket may be spring biased to a normally retracted position in one embodiment. However, the screwdriver blade is always recessed within the end of the tool and the hexagonal socket is permanently secured to the tool in all embodiments.

12 Claims, 3 Drawing Sheets

SINK CLIP TOOL

BACKGROUND OF THE INVENTION

1. Field of The Invention

The present invention relates generally to hand tools for manipulating threaded fasteners, and more specifically to a combination tool having a working end for turning either slotted or hexagonal head fasteners. The tool is particularly adapted for use in plumbing work, for securing sinks and the like in a countertop by means of clips adapted for such purpose.

2. Description of The Related Art

Various specialized fixtures, attachments, clamps, etc. have been developed for use in the plumbing trade, and as a result, numerous specialized tools have been developed for manipulating those specialized articles. An example of such is the development of the built in countertop including one or more sinks or basins set into a cutout in the countertop. Such sinks conventionally include a channel on the underside of their peripheries, which accepts the expanded end of a bolt or other threaded fastener. The threaded portion of the fastener engages a clip or clamp, which secures beneath the edge of the countertop cutout. As the fastener is tightened, the clip pulls the channel along the underside of the sink periphery, downward securely against the countertop to secure the sink tightly in place.

Various different types of clips or clamps have been developed, but each functions essentially as described above. However, two different types of threaded fasteners are in general use for securing such clips. One type includes a slotted working end, having a diameter essentially the same as that of the threaded portion of the fastener. The other type includes a relatively larger diameter, hexagonal head.

To this point, plumbers have been required to possess two different types of sink clip tools for manipulating both types of fasteners. As is well known, such small hand tools are frequently misplaced, damaged, or taken from the plumber's collection, thus requiring the plumber to replace the tools. While any single tool may only cost on the order of a few dollars, the requirement for two different tools for the different types of fasteners, along with the frequency of replacement which often occurs, can add up to a significant cost to the worker over a period of time. Moreover, the time spent in seeking out the proper tool for a specific fastener, also adds up over a period of time.

Accordingly, a need will be seen for a combination sink clip tool which fits both slotted and hexagonal head sink clip bolts or fasteners. The tool may be formed as a single, monolithic unit with a slotted blade recessed into the bottom of a hexagonal socket, or may alternatively comprise a retractable socket which fits over the blade. A discussion of the related art of which the present inventor is aware, and its differences and distinctions from the present invention, is provided below.

U.S. Pat. No. 887,644 issued on May 12, 1908 to Frank M. Jacobs describes a Tool For Connecting Up Electric Fuses having a central shank having a screwdriver blade affixed thereto and extending from one end thereof, with an axial handgrip affixedly extending from the opposite end thereof. A tubular member is coaxially sandwiched between the screwdriver blade shank and the barrel of the handle, and is biased by a spring to extend past the screwdriver blade. The tubular member includes a hexagonal socket at its working end, adjacent the screwdriver blade. However, the hexagonal socket is retractable past the screwdriver blade, so that the blade extends past the socket. Thus, no lateral guard is provided to prevent the blade from slipping laterally from the screw slot, as provided by the present tool. In the present tool, the screwdriver blade is always guarded laterally by additional structure serving as a guard to prevent the blade from slipping laterally from the slot of the threaded stud. Also, the retractable hexagonal socket embodiment of the present invention comprises an external barrel, rather than being captured between the screwdriver shank and an outer handle, as in the Jacobs device.

U.S. Pat. No. 1,318,088 issued on Oct. 7, 1919 to Charles H. Klein describes a Combination Tool having two opposite working ends with a handgrip in the center. The central shank includes a screwdriver blade at each end, with a hexagonal socket adjustably positioned thereover. However, the two hexagonal sockets can be rotated relative to the screwdriver blade, unlike the present tool.

U.S. Pat. No. 1,323,056 issued on Nov. 25, 1919 to John L. Hofmann describes a Combined Tool comprising a shank having a screwdriver blade at one end thereof, with a concentric tubular member surrounding the shank. The tubular member has a hexagonal socket on each end thereof, and may be telescoped along the shank and fixed in an extended or retracted position relative to the screwdriver blade. However, when the hexagonal socket is retracted relative to the blade, the blade is extended beyond the socket, unlike the present invention in which the blade is always at least slightly recessed within the surrounding hexagonal socket.

U.S. Pat. No. 1,677,473 issued on Jul. 17, 1928 to William W. Gast describes a Socket Wrench And Screwdriver having a telescoping tubular member disposed about a central shank. The central shank has a screwdriver blade at the working end thereof, while the tubular member includes a hexagonal socket formed at the working end thereof. The hexagonal socket is spring loaded to extend beyond the screwdriver blade, but the blade may be extended beyond the socket, unlike the present tool. Moreover, the Gast combination tool is adapted for use in valve adjustments for internal combustion engines, and as such, requires additional torque as in a conventional wrench used for loosening and securing the lock nuts in such work. Accordingly, the Gast tool includes a pair of lateral members to provide additional torque. Such members would render a sink clip tool unusable in the often tight confines below a sink and countertop, and accordingly, the present tool is devoid of such lateral or radial extensions.

U.S. Pat. No. 2,453,901 issued on Nov. 16, 1948 to Robert R. Gonsett et al. describes a Compound Wrench And Screwdriver, having an outer body portion with hexagonal sockets on each end thereof. A secondary, inner member includes smaller hexagonal sockets on each end thereof, and is telescopingly installed within the outer body portion. Finally, a screwdriver member is slidingly installed within the inner hexagonal socket member. The construction provides for the smaller socket member and/or screwdriver member to be retracted from within the outer hexagonal socket member at either end, to allow use of the larger outer hexagonal sockets. Alternatively, the inner socket member (s) and/or the screwdriver blades therein may be extended as desired: When the inner socket member is retracted at: one end, and the screwdriver member therein is extended, the screwdriver blade extends from both sockets, unlike the present tool.

U.S. Pat. No. 2,464,058 issued on Mar. 8, 1949 to Paul M. Rogers describes a Combination Wrench And Screwdriver having a configuration somewhat like a conventional wrench, i. e., with a handle extending radially from the axis of rotation of the tool. The elongate, radially extending handle precludes use of such a tool in the close confines beneath a sink and countertop, as noted further above in the discussion of the patent to Gast. Moreover, it is evident from FIG. 2 of the Rogers patent that the screwdriver bit may extend beyond the outer end of the hexagonal socket, unlike the inset screwdriver blade of the present sink clip tool, in both its monolithic and multiple component embodiments.

U.S. Pat. No. 2,566,543 issued on Sep. 4, 1951 to Edward J. Weglarz describes a Tappet Adjusting Tool having a radial or lateral handle therethrough, as in the Gast and Rogers discussed above. The Weglarz tool is thus unsuitable for use as a sink clip tool, for the same reasons noted in the discussions of the patents to Gast and Rogers. Moreover, the hexagonal socket of the Weglarz tool may be removed from the shank of the tool, unlike the permanently assembled structure of the present tool. Also, Weglarz does not disclose any limit in his tool to prevent extension of the screwdriver blade beyond the end of the hexagonal socket, whereas the screwdriver blade of the present tool is always at least slightly retracted within the surrounding hexagonal socket.

U.S. Pat. No. 3,177,910 issued on Apr. 13, 1965 to Julio A. daSilva describes a Tool Handle With Retractable Tool in which a plurality of telescoping, concentric hexagonal socket components surround a screwdriver blade or bit. The bit, and the various socket components, may be adjustably positioned to place any of their working ends at the extremity of the tool for use. This allows the screwdriver blade to be extended beyond the outer end of any of the hexagonal socket components, unlike the present tool. Moreover, the various components of the daSilva tool may be disassembled from one another, unlike the present tool, in which the components are either monolithic or are permanently secured together to preclude loss of any single component of the present sink clip tool.

U.S. Pat. No. 3,452,373 issued on Jul. 1, 1969 to James T. Vosbikian et al. describes a Combined Screwdriver And Socket Wrench in which the screwdriver shank has a hexagonal cross section, with a hexagonal socket fitting thereover and keyed to the shank by means of the mating hexagonal sections. The socket is free to slide completely up the shank to the handle portion of the tool, thus exposing the screwdriver blade and a considerable amount of the shank, unlike the present tool in which the screwdriver blade is always disposed within the walls of the hexagonal socket.

British Patent Publication No. 602,301 accepted on May 24, 1948 to Ernest T. Huntley describes An Improved Combination Tool having a small screwdriver blade or bradawl on a movable central shank, with a larger diameter housing therearound with a larger screwdriver blade at its working end. The larger blade includes a central passage therethrough, so the smaller blade may be extended therefrom. No suggestion is made of providing a hexagonal socket for the working end of the larger screwdriver, nor would such a modification be workable in the Huntley tool. The larger inner dimension of the hexagonal socket would not provide a sufficiently close fit for the smaller screwdriver shank to hold it securely within the outer structure. In contrast, the inner screwdriver blade and shank are formed as a single, unitary structure with the handle portion of the present tool, with the hexagonal socket being formed therearound, either integrally therewith or as a movable component.

German Patent Publication No. 3,016,932 published on Nov. 5, 1981 to Karl Lieser illustrates a tool having a double ended screwdriver shank removably housed centrally in the handle thereof, with a hexagonal socket disposed at one end of the handle portion. The screwdriver shank may be withdrawn from the handle, through the center of the hexagonal socket, to provide for use of the socket as desired. However, the inner dimension of the socket is relatively small, as it is used to key the relatively small diameter, mating hexagonal screwdriver shank in the handle. As in the device of the British patent publication discussed above, the Lieser tool includes a relatively movable screwdriver shank with a hexagonal socket immovably affixed to the handle, rather than forming the screwdriver blade and shank integrally with the handle as a single unitary construction, as is done with the present tool.

Finally, German Patent Publication No, 3,622,199 published on Jan. 7, 1988 to Georg Unger illustrates a screwdriver blade with a telescoping fitting at the working end thereof. The fitting is biased by a spring to extend past the end of the blade, but may be retracted so the blade may extend beyond the fitting, unlike the present tool. No hexagonal socket is apparent in the Unger tool. The fitting appears to be a retainer or guard, to prevent the blade from slipping laterally from a screw slot. The present tool also provides such a guard, but in a simpler construction with the guard component formed integrally with the blade, as a single unit.

None of the above inventions and patents, either singly or in combination, is seen to describe the instant invention as claimed.

SUMMARY OF THE INVENTION

The present invention comprises a sink clip tool for installing sinks, basins and the like in openings in countertops. The present tool includes a working end having two different types of driving means thereon, for driving threaded fasteners having either a slotted end or a hexagonal head.

A first embodiment of the present tool includes a screwdriver blade or bit which is recessed within a cylindrical passage in the end of the tool. A hexagonal socket extends from the passage. The hexagonal socket has a relatively larger inside diameter than the width of the screwdriver blade and its surrounding passage, for fitting the relatively larger hexagonal heads of the fasteners generally used to secure sink clips. The relatively smaller passage diameter surrounding the blade, acts as a guard to prevent slippage of the blade from the fastener slot, when used on such slotted fasteners. Other blade retaining means (separate guards to each side of the blade, etc.) may be provided. The first embodiment tool is formed monolithically, with both the screwdriver blade portion and hexagonal socket portion formed as a unit.

A second embodiment also includes a hexagonal socket surrounding the screwdriver blade, but the socket is telescopingly installed on the screwdriver blade shank, so it may be selectively extended past the blade, or retracted to place the blade within the end of the socket. The socket may be biased to a normally retracted position by a spring, in one embodiment. The socket is permanently attached to the blade shank in all embodiments.

Accordingly, it is a principal object of the invention to provide an improved sink clip tool for manipulating both slotted head and hexagonal head fasteners used in the installation of clips for securing sinks, basins and the like, in countertops and such.

It is another object of the invention to provide an improved sink clip tool including a working end having a screwdriver blade or bit and a hexagonal socket concentric therewith.

It is a further object of the invention to provide an improved sink clip tool which screwdriver blade includes guard means to each side or edge of the blade, to prevent the blade from slipping laterally from the slot of a screw having a slotted head.

An additional object of the invention is to provide an improved sink clip tool which screwdriver blade and hexagonal socket may be formed as a single, integral, monolithic unit, or which may alternatively be formed with the socket being telescopingly installed to the screwdriver blade shank and selectively extended or retracted as desired.

Still another object of the invention is to provide an improved sink clip tool which hexagonal socket is permanently secured to the blade shank.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
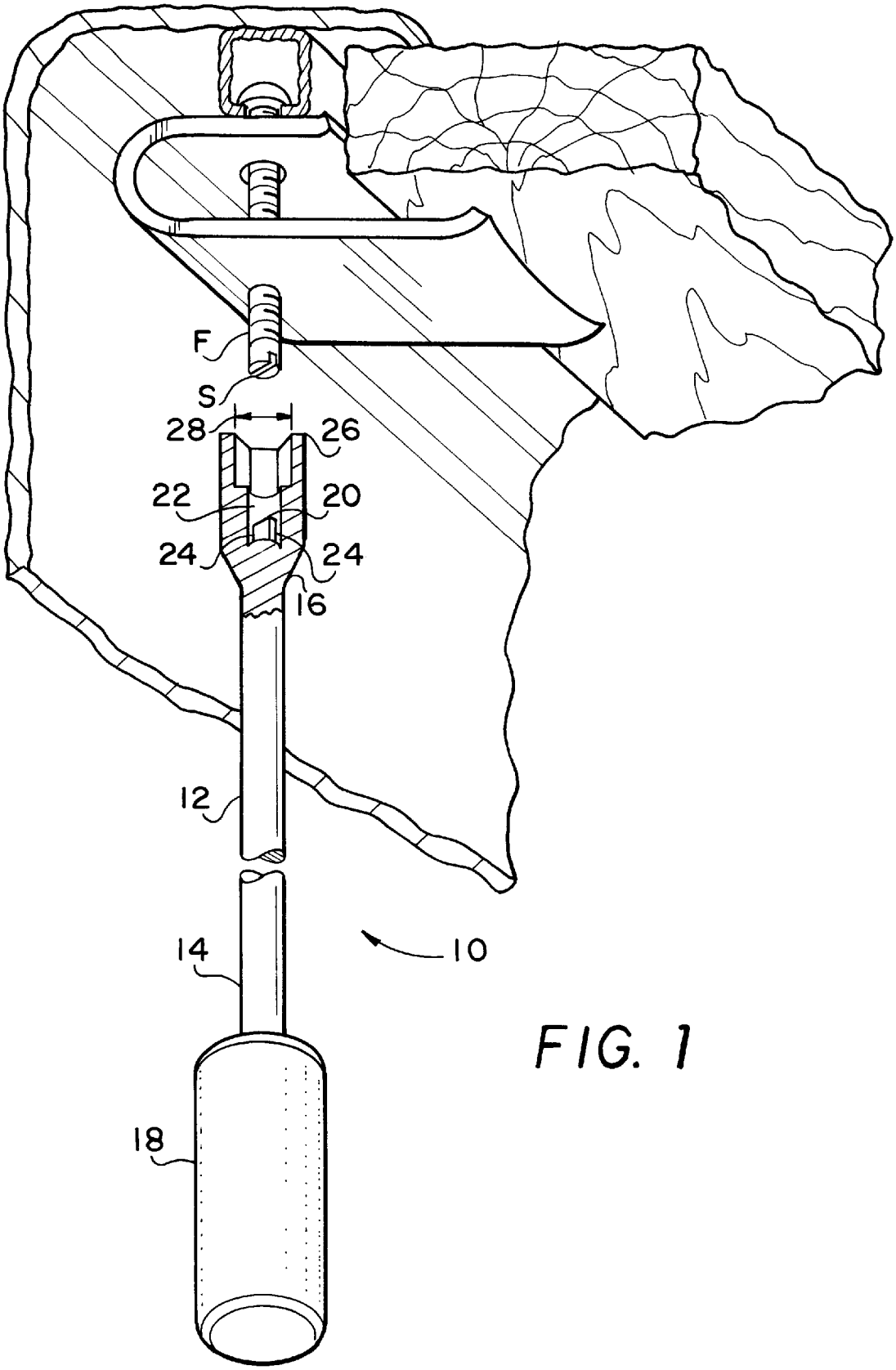
FIG. 1 is an environmental perspective view in partial section of a first embodiment of the present sink clip tool, showing its use in the manipulation of a slotted head sink clip fastener, and the unitary construction of the tool.

The present invention comprises various embodiments of a sink clip tool, providing for the manipulation of different types of threaded fasteners conventionally used in securing sinks, basins and the like within openings formed in countertops and the like. FIG. 1 provides an environmental perspective view, in partial section, of a first embodiment of the present sink clip tool, designated by the reference character 10. The tool 10 generally comprises a solid, elongate shank or shaft 12, having a handle end 14 and an opposite working end 16. The shank 12 and ends 14 and 16 are preferably formed of tool steel or other suitable material.

The handle end 14 preferably includes a handgrip 18 extending therefrom and concentric therewith, for a user to manipulate the tool 10. The handgrip 18 may be plastic, either solid or coated with a resilient material, or other suitable material to provide a good grip and comfort for the user. It will be seen that the handgrip 18 has a maximum diameter which is greater than the diameter of the opposite working end 16 of the tool 10, in order to provide a good grip for a user of the tool 10. However, the diameter of the handgrip 18 is the largest lateral or radial dimension of the tool 10, with the tool 10 being devoid of any additional lateral or radial protrusions. While such protrusions are known in hand tools in order to provide greater torque or leverage for the user, they are unsuitable for use in the intended environment of the present sink clip tool 10, i. e., beneath sinks and countertops where little space is provided for manipulating such a tool.

The working end 16 of the tool 10 includes a screwdriver blade 20 therein, formed concentrically with the shank 12. The blade 20 is preferably a flat component, configured to fit the slot of a conventional threaded fastener. However, other types of tips may be provided to fit other types of threaded fasteners if so desired, e. g., Phillips (tm), Torx (tm), etc. In the field of sink installation, however, the conventional fasteners used are either slotted or have a hexagonal head thereon, with the present tool 10 as shown and described, being configured to fit both of these conventional fasteners.

The blade 20 is recessed in a concentric receptacle 22 formed within the working end 16 of the tool 10. The inner diameter of the receptacle 22 is about the same as, or slightly larger than, the width of the blade 20. In this way, when the blade 20 engages the slot S of a fastener F, as shown in FIG. 1, the continuous circular inner walls of the receptacle 22, with their close fit about the opposite lateral edges 24 of the blade 20, prevent the lateral slippage of the blade 20 from the slot S of the fastener F. The present sink clip tool 10 disclosed in FIG. 1 may include somewhat different forms of guard means than the receptacle 22 which fits closely about the screwdriver blade 20. Such alternative guard means are described further below in the discussion of the tool embodiments of FIGS. 2 and 3.

A hexagonal socket 26 extends beyond the tip of the screwdriver blade 20 and its surrounding receptacle 22. The hexagonal socket is concentric with the shank 12 of the tool 19 and is configured to engage conventional hexagonal head fasteners or fittings used in sink installation, as will be shown in FIG. 2 of the drawings. While the head of the slotted fastener F of FIG. 1 is essentially the same diameter as that of the threaded portion of the fastener F, such hexagonally headed fasteners universally have a head having a much larger diameter than the threaded portion of the fastener. Accordingly, the inner diameter 28 of the hexagonal socket 26 is considerably larger than the diameter of the fastener receptacle 22 and/or the width of the screwdriver blade 20, in the tool 10 of FIG. 1.

The need to provide for the manipulation of two different diameters and configurations of fasteners, is the reason for the fastener receptacle 22 surrounding the screwdriver blade 20 of the tool 10 of FIG. 1. If the larger inner diameter 28 of the hexagonal socket 26 were continued to the base of the screwdriver blade 20, the working end 14 of the tool 10 could slip laterally about the end of a relatively small diameter slotted fastener S, to the extent of the inner diameter 28 of the hexagonal socket 26. Thus, the blade 20 could easily slip laterally from the slot S of a relatively small diameter slotted fastener S, as shown in FIG. 1, unless the blade 20 were formed to extend completely across the inner diameter 28 of the hexagonal socket 26. While this would preclude the slippage of the blade 20 from the slot S, the fit of the tool 10 on such a small diameter slotted fastener F would not be positive, and it still might be possible for the end of the fastener F to fit between the side of the blade 20 and the inner wall of the hexagonal socket 26. Hence, the present construction described above for the tool 10, with its relatively small diameter receptacle 22 serving to fit closely about the slotted end of the fastener S and serving as a guard means for the blade 20, provides a much more positive acting and satisfactory tool.

Preferably, the construction of the shank 12 of the tool 10, with its working end 16 comprising the screwdriver blade 20, receptacle 22, and hexagonal socket 26, is accomplished as a single, solid, monolithic unit, devoid of separate parts. However, the device may be constructed of multiple parts, if so desired.

Figure 2:
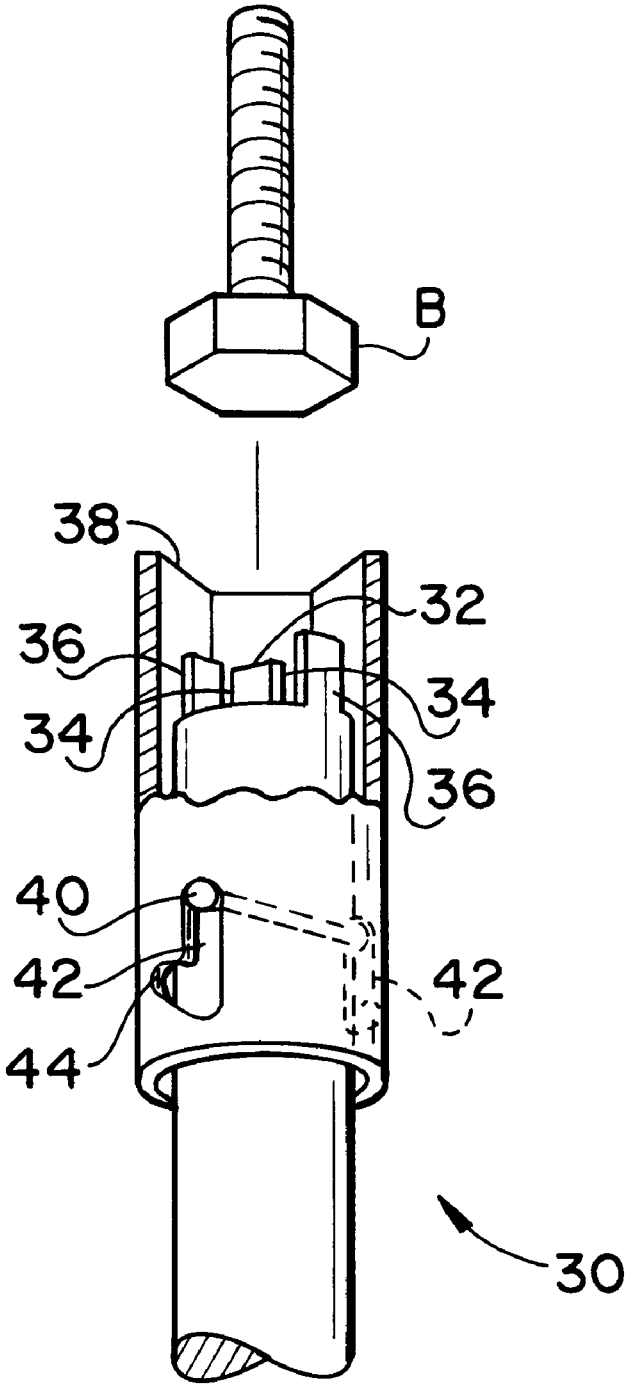
FIG. 2 is a detailed perspective view of the working end of a second embodiment of the present sink clip tool, showing an adjustable hexagonal socket working end which may be extended or retracted as desired.

FIG. 2 illustrates the working end 30 of an alternative embodiment of the present tool 10. While the working end 30 of the tool shown in FIG. 2 is different from the working end 16 of the tool 10 of FIG. 1, it will be understood that the remainder of the shank portion, with its handle end and handgrip, is identical between the two embodiments, and also to the embodiment shown in FIG. 3 and discussed further below.

The working end 30 shown in FIG. 2 includes a screwdriver bit or blade 32 therein, with the blade 32 having opposite first and second lateral edges 34. Corresponding separate, opposite first and second lateral walls 36 are provided immediately adjacent each of the lateral edges of the blade 32, for the purpose of precluding lateral slippage of the blade 32 from the slot of a slotted fastener, as described further above in the discussion of the tool 10 of FIG. 1. While the structure of the guard means 36 of the tool working end 30 of FIG. 2 is somewhat different from the guard means comprising the fastener receptacle 22 of the tool 10 of FIG. 1, the purpose and function remain the same.

The tool working end 30 shown in FIG. 2 also includes a hexagonal socket drive thereon, somewhat like the hexagonal socket 26 of the tool 10 of FIG. 1. However, the hexagonal socket 38 of FIG. 2 is a separate component of the working end 30, and is not immovably affixed to the working end 30. Rather, the hexagonal socket 38 may be selectively extended and retracted as desired, in order to position the screwdriver bit or blade 32 relatively farther from or closer to the outer end of the socket 38, as desired.

The selectively retractable hexagonal socket 38 essentially comprises a sleeve which fits concentrically about the working end 30 and screwdriver blade 32 of the tool. The socket or sleeve 38 is generally free to move axially about the working end 30 of the tool, but is captured thereon by a lateral pin 40 which passes through the working end 30 of the tool, and through opposite J-shaped slots 42 formed in opposite sides of the sleeve or socket 38. These two slots 42 each have a hooked or curved socket extension retaining end 44, and a longer, straight portion which allows the socket 38 to be retracted relative to the working end 30 and blade 32.

When it is desired to extend the socket 38, the sleeve 38 need only be pulled or moved axially toward its hexagonal outer end, and turned slightly to engage the pin 40 in the hooked portion 44 of the slots 42. Thus, when pressure is applied to the extended socket 38, the ends of the pin 40 will seat in the hooked portion 44 of the slots 42, precluding retractile movement of the hexagonal sleeve or socket 38 along the working end 30 of the tool. When pressure is released from the tool, the socket 38 is easily turned and withdrawn back along the working end 30, to position the screwdriver blade 32 closer to the open end of the socket 32.

The hexagonal socket 32 is permanently secured to the working end 30 of the tool of FIG. 2, by means of the pin 40 which engages the slots 42. Thus, while the socket 32 may be moved axially (and slightly radially) about the working end 30 of the tool to the extent of the slots 42, it cannot be removed from the working end 30 of the tool.

Figure 3:
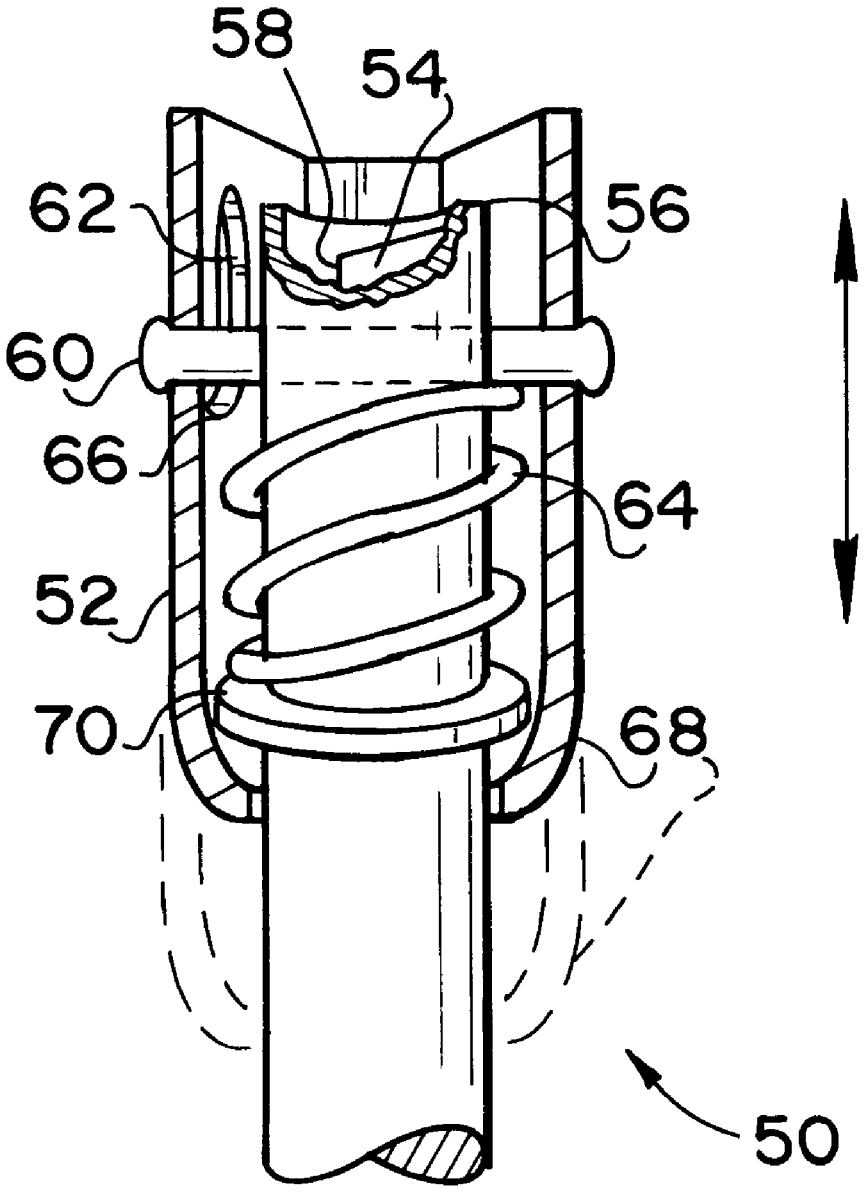
FIG. 3 is a detailed elevation view in partial section of an alternative embodiment of the tool of FIG. 2, including a spring for biasing the hexagonal socket to a normally retracted position.

FIG. 3 illustrates a further embodiment of the present sink clip tool, in which the working end 50 and the hexagonal socket 52 retractably installed thereon, includes a spring urging the socket 52 to a retracted position. The working end 50 shown in FIG. 3 includes a screwdriver blade or bit 54, formed concentrically with the shaft working end 50, as in the embodiments of FIGS. 1 and 2. The blade 54 may include opposite guard walls, as in the walls 36 shown for the screwdriver blade 32 of FIG. 2, or may comprise a continuous circular wall 56 disposed about the blade 54, as shown in FIG. 3. Additional structural strength may be achieved by extending the width of the blade 54 so that its lateral edges 58 attach to the inner surface of the circular wall 56, as shown, or conversely, forming the circular wall 56 to have a sufficiently small inner diameter to attach to a relatively narrow screwdriver blade.

The hexagonal socket 52 of the working end 50 of the tool shown in FIG. 3, is telescopingly installed on the working end 50 so that it may be axially extended and retracted as desired. The socket 52 is permanently retained on the working end 50 by means of a lateral pin 60 through the working end 50 which engages opposite bayonet slots 62 formed in the sides of the socket 52, in the manner discussed above for retaining the socket 38 on the working end 30 of the tool of FIG. 2. However, the spring 64 disposed concentrically about the shank working end 50, is captured between and exerts a compressive force between the lateral pin 60 and the base 66 of the socket 52, urging the socket 52 to a retracted position.

The socket 52 may be repositioned to an extended state (shown in solid lines in FIG. 3) by grasping the socket 52 and pressing it downwardly (in the orientation seen in FIG. 3) toward the opposite, handle end (not shown) of the tool. Once the socket 52 has reached the hooked or curved end portion(s) 66 of the slot(s) 62, the socket 52 is turned slightly to capture the ends of the pin 60 in the hooked portion(s) 66 of the slot(s) 62, thereby retaining the socket 52 in its extended position in order to engage a hexagonal head fastener more effectively and to keep the screwdriver blade 54 (and its guard 56) clear of the hexagonal head fitting.

When it is desired to retract the hexagonal socket 52, the user of the tool need only twist or turn the socket 52 slightly relative to the tool working end 50, to disengage the hooked end(s) 66 of the slot(s) 62 from the ends of the pin 60. The spring 64 will then force the socket 52 to a retracted position (shown in broken lines in FIG. 3), to provide additional clearance for the screwdriver blade 54. (The spring may apply its compressive force against the bottom portion 68 of the socket 52, or against a seat 70 within the socket 52.)

In summary, the above described sink wrench tool, in its various embodiments, serves as a handy tool or accessory for those engaged in sink installations and related plumbing work. The present tool 10, in its various embodiments, performs the work of two tools previously required for such work.

The present tool may be used to manipulate (tighten or loosen) slotted fasteners, such as the fastener F of FIG. 1, having a head portion of essentially the same diameter as the remainder of the fastener, with the guard means to each edge of the screwdriver blade serving to retain the blade within the slot S of the fastener F. Also, by configuring the tool properly, the hexagonal socket may be used to manipulate hexagonal headed fasteners, such as the bolt B of FIG. 2. The hexagonal socket may be formed integrally with the screwdriver and blade guard means, as shown in FIG. 1, or may alternatively be formed to retract and extend as desired, axially about the working end of the tool shaft or shank. In the case of such an extendible and retractable socket, a spring may be provided to urge the socket to a normally retracted (or, a normally extended position, if so desired, depending upon the specific configuration), in order to provide more positive placement of the socket relative to the remainder of the tool.

In any event, the screwdriver blade is always retained within the walls of the socket, whether extended, retracted, or immovably affixed, in order to preclude interference with the top of a hexagonal head fastener when the present tool is used with such a fastener. Nevertheless, the reach of the screwdriver blade is sufficient to engage slotted fasteners as well, even with the hexagonal socket surrounding the blade. Thus, the present tool will serve as a welcome accessory to all those who are involved in the sink installation and plumbing fields.

It is to be understood that the present invention is not limited to the embodiments described above, but encompasses any and all embodiments within the scope of the following claims.

I claim:

1. A sink clip tool, comprising:

a solid, elongate shank having a handle end and a working end including a pin opposite said handle end;

said working end of said shank including a screwdriver blade concentric with said elongate shank;

said screwdriver blade having a width refined by opposite lateral edges, there further being guard means including a separate lateral wall immediately adjacent each of said lateral edges of said screwdriver blade and cooperating with said lateral edges for precluding the lateral slippage of said blade from the slot of a slotted fastener, and fitting closely about at least said lateral edges of said blade;

said working end of said shank further including a hexagonal socket concentric with said shank and with each said lateral wall of said guard means, and extending beyond said screwdriver blade, with said hexagonal socket having a pair of J-shaped tracks, one in each of its opposite sides, for receiving said pin and having an internal diameter larger than said width of said screwdriver blade, such that said socket can be adjusted with respect to said shank by changing the position of said pin in said tracks; and said hexagonal socket is formed as a separate component telescopingly secured about said working end of said shank.

2. The sink clip tool according to claim 1, wherein said hexagonal socket is permanently attached to said working end of said shank.

3. The sink clip tool according to claim 1, including spring means disposed between said working end of said shank and said hexagonal socket, with said spring means urging said hexagonal socket to a retracted position relative to said screwdriver blade.

4. The sink clip tool according to claim 1, including a handgrip disposed at said handle end of said shank, and concentric with said shank.

5. The sink clip tool according to claim 1, including a handgrip disposed at said handle end of said shank and concentric with said shank, with said handgrip having a maximum diameter; and said tool having a maximum diameter equivalent to said maximum diameter of said handgrip, for working in confined areas.

6. The sink clip tool according to claim 1, wherein said width of said screwdriver blade extends and attaches to said guard means of each of said lateral edges thereof.

7. A sink clip tool, comprising:

a solid, elongate shank having a handle end and a working end including a pin opposite said handle end;

said working end of said shank including a screwdriver blade concentric with said elongate shank;

said screwdriver blade having a width defined by opposite lateral edges, there further being guard means cooperating with said lateral edges for precluding the lateral slippage of said blade from the slot of a slotted fastener, and fitting closely about at least said lateral edges of said blade;

said working end of said shank further including a hexagonal socket concentric with said shank and with said screwdriver blade, and extending beyond said screwdriver blade, with said hexagonal socket having a pair of J-shaped tracks, one in each of its opposite sides, for receiving said pin and having an internal diameter larger than said width of said screwdriver blade, such that said socket can be adjusted with respect to said shank by changing the position of said pin in said tracks;

said hexagonal socket is formed as a separate component telescopingly secured about said working end of said shank; and spring means disposed between said working end of said shank and said hexagonal socket, with said spring means urging said hexagonal socket to a retracted position relative to said screwdriver blade.

8. The sink clip tool according to claim 7, wherein said hexagonal socket is permanently attached to said working end of said shank.

9. The sink clip tool according to claim 7, including a handgrip disposed at said handle end of said shank and concentric with said shank, with said handgrip having a maximum diameter; and said tool having a maximum diameter equivalent to said maximum diameter of said handgrip, for working in confined areas.

10. The sink clip tool according to claim 7, wherein said guard means comprise a separate lateral wall immediately adjacent each of said lateral edges of said screwdriver blade.

11. The sink clip tool according to claim 7, wherein said guard means comprise a continuous circular wall disposed about said screwdriver blade.

12. The sink clip tool according to claim 7, wherein said width of said screwdriver blade extends and attaches to said guard means of each of said lateral edges thereof.

* * * * *